United States Patent [19]

Beattie et al.

[11] Patent Number: 4,468,943

[45] Date of Patent: Sep. 4, 1984

[54] LIVE BOLT LOCK MECHANISM FOR SAFE DOOR

[75] Inventors: Patrick J. Beattie, Henrietta; Douglas E. Shaffer; Richard J. Sylvester, both of Rochester, all of N.Y.

[73] Assignee: John D. Brush & Co., Inc., Rochester, N.Y.

[21] Appl. No.: 429,818

[22] Filed: Sep. 30, 1982

[51] Int. Cl.[3] ..... E05C 9/06; E05B 63/14; E05B 37/08

[52] U.S. Cl. ..... 70/302; 70/119; 70/303 A; 70/315; 70/321; 292/36

[58] Field of Search ..... 109/59; 70/1.5, 119, 70/120, 301-303 A, 114-116, 315, 329, 321-323, 331; 292/6, 7, 36

[56] References Cited

U.S. PATENT DOCUMENTS

| | | | |
|---|---|---|---|
| 370,056 | 9/1887 | Harris | 70/322 |
| 390,528 | 10/1888 | Spivey | 70/315 |
| 489,447 | 1/1893 | Averbeck | 70/322 X |
| 605,919 | 6/1898 | Sayre . | |
| 975,549 | 11/1910 | Lowrie | 70/315 |
| 1,909,697 | 5/1933 | MacBeth et al. | 292/36 |
| 2,766,608 | 10/1956 | Hirn | 70/119 X |
| 3,504,618 | 4/1970 | Rosner . | |
| 3,778,079 | 12/1973 | Vornberger et al. | 292/36 X |
| 4,306,432 | 12/1981 | Ravid | 292/36 X |

FOREIGN PATENT DOCUMENTS

| | | | |
|---|---|---|---|
| 361241 | 10/1922 | Fed. Rep. of Germany | 292/36 |
| 1449025 | 7/1966 | France | 292/36 |

*Primary Examiner*—Gary L. Smith
*Assistant Examiner*—Russell W. Illich
*Attorney, Agent, or Firm*—Stonebraker, Shepard & Stephens

[57] ABSTRACT

A live bolt lock mechanism for a safe door uses a rotatable idler 15 in a middle region of the door. A plurality of live bolts 20 spaced around the door each has a connecting rod 19 joined to the idler 15 at crank locations for operating the live bolts. A handle 25 is mounted between the idler and the opening edge of the door, and a combination lock 30 is mounted beside the idler. An actuator 27 rotated by the handle moves an actuator link 31 connected to the idler for rotating the idler when the handle turns. A lock link 50 mounted on the idler and extending toward the combination lock 30 has a projection disposed adjacent the combination lock to block the lock link and idler from movement unless a combination for the lock is fulfilled.

13 Claims, 3 Drawing Figures

LIVE BOLT LOCK MECHANISM FOR SAFE DOOR

BACKGROUND

Live bolts for safe doors are normally operated by a crank assembly turned by a handle. Since it is best to space the live bolts uniformly around the safe door and not crowd them too close to the opening edge of the door, the crank assembly for the live bolts is preferably located in a mid-region of the door. This also locates the operating handle in the mid-region of the door where the space left for interaction with a combination lock is restricted.

Such spacial limitations, along with manufacturing tolerance problems of conventional live bolt locks, led us to an improved mechanism that not only solves these problems, but also works better and costs less. We have refined this for simplicity, operating effectiveness and reliability at a low cost in our improved live bolt mechanism.

SUMMARY OF THE INVENTION

Our live bolt lock mechanism for a safe door separates the door handle from a crank assembly that operates the live bolts. The door handle is mounted near the opening edge of the safe door and it turns a few degrees to operate in a conventional and convenient way. Movement of the handle is transmitted via an actuator and an actuator link to a rotatable idler in a middle region of the door. The idler has crank locations for connecting rods leading to a plurality of live bolts spaced around the door. A combination lock is mounted beside the idler, and a lock link mounted on the idler extends toward the combination lock. The lock link has a projection disposed adjacent the combination lock to block the lock link and idler from movement unless a combination for the lock is fulfilled.

DRAWINGS

DETAILED DESCRIPTION

Figure 1:
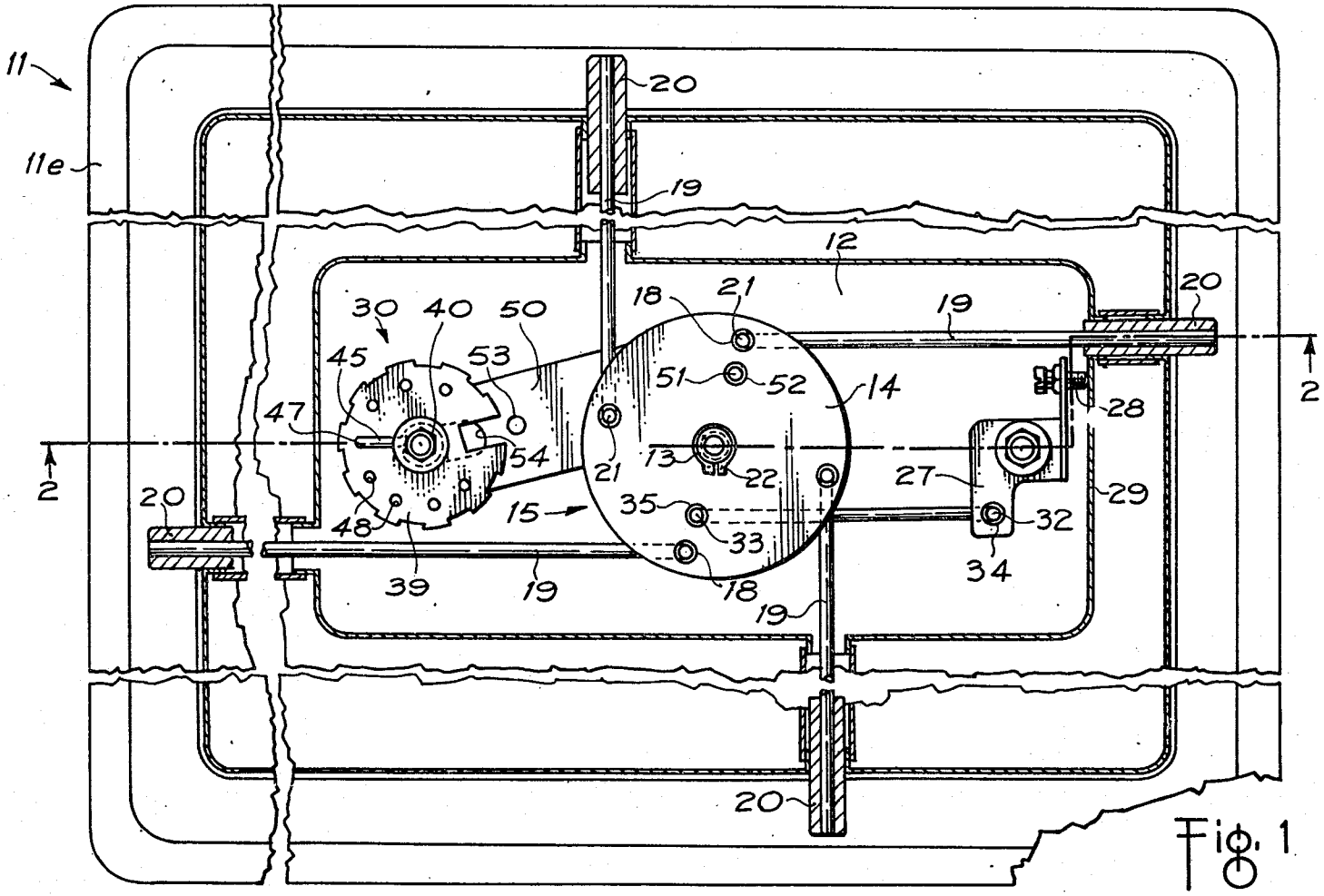
FIG. 1 is a cross-sectional view of a preferred embodiment of a safe door made according to the invention and viewed from inside the safe with the inner surface of the door cut away to expose the live bolt mechanism.

As a matter of human engineering, we found it better to place a safe door handle well toward a left side opening edge of a safe door with the handle extending toward the center of the door and arranged for opening the door by levering downward or clockwise. This is conventional and natural for most people whose hand can go from a combination lock to the handle and operate it with a familiar 30° turn. However, this made handle operation of a live bolt mechanism very difficult, and tended to crowd the live bolts toward the left of the door along its opening edge, rather than distributing them evenly around the door, which is much preferred.

In solving these problems, we discovered that a live bolt mechanism can be operated by an idler positioned in a central region of the safe door. The idler can be operated by a handle mechanism spaced from the idler and connected to it by an actuator link. This realization then led to a succession of improvements that simplified and reduced the cost of a crank assembly for live bolts, a simple and effective interaction between a combination lock and the live bolt assembly, and an equally simple and effective interrelationship between an operating handle and the live bolt idler.

The preferred embodiment that resulted from this is illustrated in the drawings and has several important advantages over previous live bolt mechanisms for safe doors. It spaces the live bolts nearly uniformly around the safe door for optimum effectiveness, and it operates them with a simple idler mechanism that reduces the number of parts and the cost of manufacture. The spacial problems are solved because the handle is in the right place and oriented for most convenient operation, and there is plenty of room for a combination lock. The mechanism is generally compact, rugged, effective, and reliable, and yet it is cheaper to build than previous devices for the same purpose.

Door 11 of safe 10 has a left opening edge 11*e* as viewed by the user from outside the safe. Its operating handle 25 is arranged near its opening edge 11*e*, and a combination lock 30 is arranged next to handle 25. On the inside of door 11 within a walled recess 12 is arranged a live bolt operating mechanism as explained below.

Figure 2:
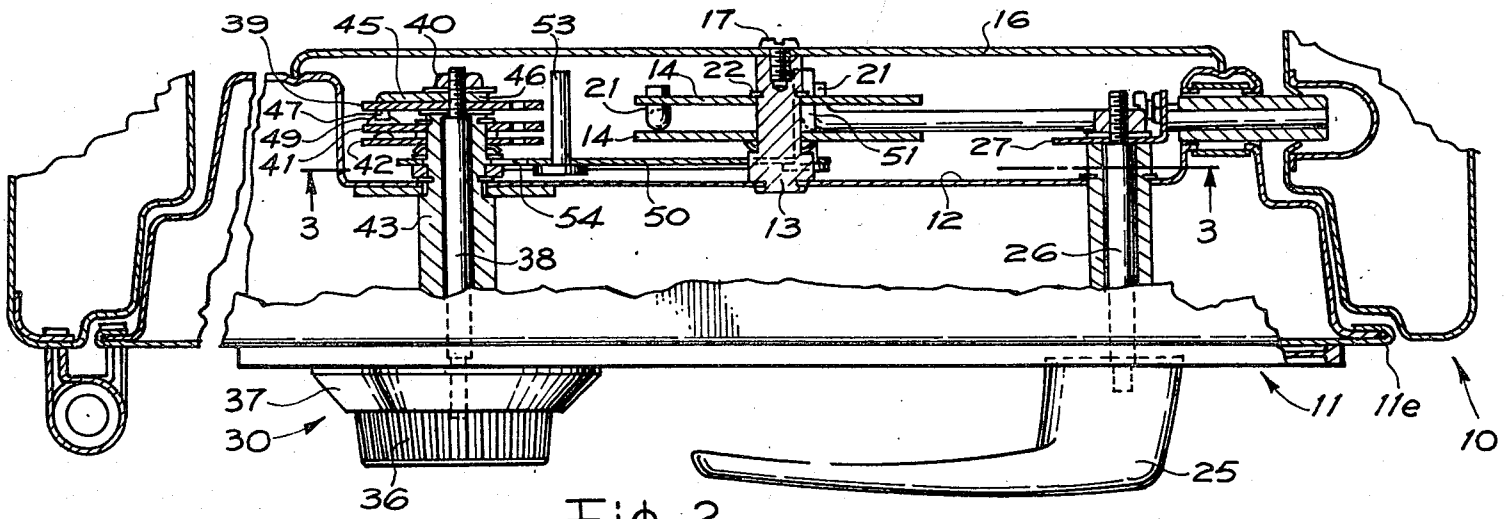
FIG. 2 is a cross-sectional view of the safe door of FIG. 1 taken along the line 2—2 thereof.
Figure 3:
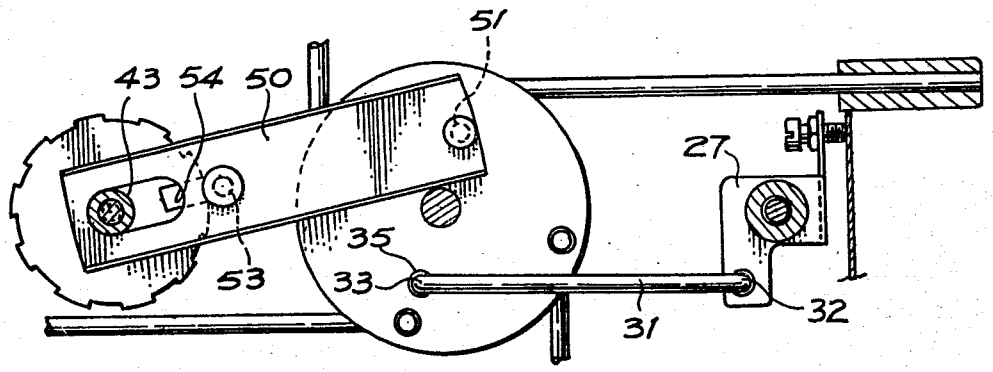
FIG. 3 is a fragmentary cross-sectional view of the line bolt mechanism of FIG. 2 taken along the line 3—3 thereof.

Within recess wall 12 in a central region of door 11 is a rotatable idler 15 formed of a pair of identical disks 14 mounted for free rotation on an axle 13. A cover 16 extending over recess 12 and omitted from the view of FIG. 1 is fastened to axle 13 by a screw 17 as shown in FIG. 2 to conceal and protect the lock mechanism and help support axle 13 in place.

Idler disks 14 have peripheral apertures 18 that form crank locations for four live bolts 20. The inward ends 21 of connecting rods 19 have right angle bends lodged in apertures 18 and forming cranks that operate live bolts 20 when idler 15 turns. Connecting rods 19 extend between idler disks 14 with their angled crank ends 21 trapped in openings 18 when disks 14 are fastened in place by a retaining ring 22. This forms a simple and effective crank assembly using a few economical parts.

Handle 25 on the outside of door 11 operates to turn idler 15 if combination lock 30 permits. Handle 25 can have a separate key lock (not shown) that can provide extra security by requiring a key for moving handle 25. Handle spindle 26 extends into recess 12, and an actuator 27 mounts on spindle 26 to form a crank arm rotated by handle 25. When handle 25 turns, actuator 27 also turns, and its movement is imparted to idler 15 by an actuator link 31 formed as a rod extending between actuator 27 and idler disks 14. Actuator link 31 has its ends 32 and 33 bent at right angles to fit respectively into a hole 34 in actuator 27 and a pair of registered holes 35 in identical disks 14. Actuator link 31 then extends along recess wall 12 behind the idler disk 14 closest to the front of the safe door and is thus trapped in place and out of the plane of operation of connecting rods 19 so as not to interfere with their movements.

An adjustment screw 28 mounted on actuator 27 sets a home position for handle 25 by engaging an abutment formed by a side wall 29 of recess 12. This sets handle 25 in a horizontal position when safe door 11 is locked.

Turning handle 25 between opened and closed positions operates actuator 27 and actuator link 31 to rotate idler 15 between open and closed positions. This in turn moves connecting rods 19 and live bolts 20 between open and closed positions. Actuator link 31 is connected to idler disks 14 at a shorter radius than crank locations 18 for connecting rods 19. This allows handle 25 to move about 30° through a comfortable arc and impart enough rotation to idler 15 via actuator link 31 to achieve adequate throw for live bolts 20.

Combination lock 30 lets idler 15 rotate this if the combination is fulfilled, and lock 30 otherwise blocks movement of idler 15 and keeps door 11 locked. Although lock 30 includes some conventional components, it has a unique working relationship with idler 15.

Lock 30 has a combination knob 36 and a partial cover 37 on the outside of door 11. A spindle 38 extends inward from knob 36 into recess 12, and a drive wheel 39 is secured on the inner end of spindle 38 by a nut 40. Tumbler wheels 41 and 42 are mounted for free rotation on a bushing 43 surrounding spindle 38.

A drive pin formed as a wire element or a stamped and coined element 45 with a loop 46 encircling and supported on spindle 38 next to drive wheel 39 is also held in place by nut 40, and the free end 47 of element 45 is bent at a right angle to form pin 47 that extends through one of a plurality of holes 48 in drive wheel 39. Drive pin 47 engages a conventional projection 49 on the adjacent tumbler wheel 41 and substitutes for a self tapping screw previously threaded through one of the holes 48. Element 45 is simple to make and easier to assemble than a self tapping screw. Also, element 45 makes it much easier to change the combination of lock 30. Removing nut 40 allows element 45 to be rotated so that its pin end 47 can be placed through a different hole 48 in drive wheel 39, and this changes the relative rotational position where drive wheel 39 engages and carries tumbler wheel 41 along in its rotation. This changes the combination of lock 30 in a simple and convenient way.

A lock link 50 extends between idler 15 and combination lock 30 for operational connecting these components. The idler end of link 50 is trapped between recess wall 12 and idler disks 14, and it is connected to disks 14 by a pin 51 that extends loosely through registered holes 52 in idler disks 14. Holes 51 are located at a suitable radius on idler disks 14 for moving link 50 an appropriate linear distance toward lock 30 when idler 15 rotates to open safe door 11.

Adjacent the drive and tumbler wheels of combination lock 30, a lock pin 53 on lock link 50 blocks the movement of link 50 unless the combination of lock 30 is fulfilled by placing all the notches of the drive and tumbler wheels adjacent pin 53. The lock end of link 50 has an oval slot 54 that surrounds and guides on bushing 43 around spindle 38. This allows lock link 50 to slide back and forth radially of spindle 38 if the combination is fulfilled and permits pin 53 to move. If the combination is not fulfilled as illustrated, lock 30 blocks pin 53 and link 50, thus preventing rotation of idler disks 14, movement of live bolts 20, or opening of door 11.

Even if lock spindle 38 is forcefully driven into the interior of safe 10 with a sledge hammer, it does not carry tumbler wheels 41 or 42 with it, and does not disrupt lock link 50 which remains blocked from movement by its pin 53 engaging tumbler wheels 41 and 42. Lock link 50 is also stout enough to resist strain on handle 25 so that there is no quick way of opening door 11 without knowing the combination of lock 30.

Spacially separating handle 25 in idler 15 led to some surprising improvements as shown in the illustrated embodiment. The support, rotation, and adjustment of the home position for handle 25 are all separate from idler 15, which relieves manufacturing tolerances for these components. Idler 15 can then be formed as a simple pair of identical disks 14 rotating around a fixed axle 13 and economically providing the crank locations necessary for connecting rods 19. These are merely rods with bent ends 21 trapped between disks 14 so that ends 21 serve as cranks. The trapping and pinning of actuator link 31 and lock link 50 are also economical and effective. Assembly is quick and efficient, the live bolts 20 have an adequate throw, and handle 25 is in a comfortable position and turns only about 30° in its operating arc. The end result is sturdy, effective, and reliable at a lower cost than was previously possible.

We claim:

1. A safe door live bolt lock mechanism comprising:

a. a rotatable idler arranged in a middle region of said safe door, said idler having crank locations;

b. a plurality of live bolts spaced around said safe door;

c. a plurality of connecting rods extending between said live bolts and said idler;

d. means for joining said connecting rods to said crank locations on said idler so that said connecting rods operate said live bolts when said idler turns;

e. a safe door handle mounted between said idler and an opening edge of said safe door;

f. a combination lock mounted on said safe door in a position spaced from both said idler and said handle;

g. an actuator rotated by said handle;

h. an actuator link connected between said actuator and said idler for rotating said idler when said handle turns;

i. a lock link mounted on said idler for movement toward said combination lock when said idler turns; and j. said lock link having a projection disposed adjacent said combination lock to block said lock link and said idler from movement unless a combination for said lock is fulfilled.

2. The mechanism of claim 1 wherein said combination lock has a spindle, and said lock link has an oblong slot that surrounds and guides on said spindle.

3. The mechanism of claim 1 wherein said combination lock has a spindle, tumbler wheels, and a drive wheel with a plurality of holes; and a drive pin supported on said spindle extends through one of said holes in said drive wheel to engage a projection on one of said tumbler wheels.

4. The mechanism of claim 1 including an abutment surface in the region of said actuator and a stop screw mounted on said actuator to engage said abutment surface to set a home position of said actuator and said handle.

5. The mechanism of claim 1 wherein the inside of said safe door has a recess housing said idler, actuator, actuator link, lock link, and combination lock; said idler has an axle mounted in said recess; a cover fits over said recess; and a fastener secures said cover to said axle for said idler to help support said axle in place.

6. The mechanism of claim 1 wherein said connection of said actuator link to said idler is at a shorter radius than said crank locations so that said live bolts move farther in response to rotation of said idler than said actuator link moves in rotating said idler.

7. The mechanism of claim 1 wherein said idler is formed of a pair of disks having holes at said crank locations, and end regions of said connecting rods have right angle bends extending through said holes in said idler disks.

8. The mechanism of claim 7 wherein said connecting rods are disposed between said idler disks with said end regions extending through said holes in one of said idler disks.

9. The mechanism of claim 8 wherein said connection of said actuator link to said idler is at a shorter radius than said crank locations so that said live bolts move farther in response to rotation of said idler than said actuator link moves in rotating said idler.

10. The mechanism of claim 7 wherein said combination lock has a spindle, and said lock link has an oblong slot that surrounds and guides on said spindle.

11. The mechanism of claim 10 including an abutment surface in the region of said actuator and a stop screw mounted on said actuator to engage said abutment surface to set a home position of said actuator and said handle.

12. The mechanism of claim 11 wherein said combination lock has a spindle, tumbler wheels, and a drive wheel with a plurality of holes; and a drive pin supported on said spindle extends through one of said holes in said drive wheel to engage a projection on one of said tumbler wheels.

13. The mechanism of claim 12 wherein the inside of said safe door has a recess housing said idler, actuator, actuator link, lock link, and combination lock; said idler has an axle mounted in said recess; a cover fits over said recess; and a fastener secures said cover to said axle for said idler to help support said axle in place.

* * * * *